United States Patent [19]

Kelley

[11] Patent Number: 4,826,125

[45] Date of Patent: May 2, 1989

[54] FOLDING EASEL

[76] Inventor: James O. Kelley, 19130 North Shore Dr., Spring Lake, Mich. 49456

[21] Appl. No.: 63,165

[22] Filed: Jun. 17, 1987

[51] Int. Cl.[4] ..... A47B 97/04

[52] U.S. Cl. ..... 248/463; 248/435; 248/431

[58] Field of Search ..... 248/465, 463, 165, 166, 248/431, 435, 188.6, 288.3, 460, 462, 276; 403/217, 56, 123, 145; 40/610

[56] References Cited

U.S. PATENT DOCUMENTS

| | | | |
|---|---|---|---|
| 191,577 | 6/1877 | Fisher | 248/465 |
| 294,941 | 3/1884 | Werner | 248/463 |
| 299,391 | 5/1884 | Ireland | 248/465 |
| 384,171 | 6/1888 | Morris | 248/463 |
| 512,471 | 1/1894 | Holt | 248/165 X |
| 1,523,399 | 1/1925 | Chamberlin | 403/56 X |
| 2,019,214 | 10/1935 | Denny | 248/188.6 X |
| 2,064,232 | 12/1936 | Tepper | 248/460 X |
| 3,168,274 | 2/1965 | Street | 248/276 X |
| 4,017,049 | 4/1977 | Albee, Jr. | 248/464 |
| 4,022,418 | 5/1977 | Kellner | 248/460 |
| 4,171,116 | 10/1979 | Carver et al. | 248/465 X |

FOREIGN PATENT DOCUMENTS

| | | | |
|---|---|---|---|
| 18947 | 8/1896 | United Kingdom | 248/460 |
| 19868 | 9/1908 | United Kingdom | 248/460 |
| 1568970 | 6/1980 | United Kingdom | 248/460 |

*Primary Examiner*—Ramon S. Britts
*Assistant Examiner*—Karen J. Chotkowski
*Attorney, Agent, or Firm*—Varnum, Riddering, Schmidt & Howlett

[57] ABSTRACT

A folding easel wherein there is an articulated joint between the upper ends of the legs and a further articulated joint between support arms and a central leg. Each articulated joint includes a ball and socket arrangement with there being a loop of elastic cord extending through the legs and the ball and sockets to hold the parts together while functioning as a pivot member. The support arms are secured to the central leg utilizing a similar ball and socket and loop of elastic cord arrangement. An elastic cord also extends between outer ends of the support arms for holding the support arms in the operative state of the easel. The same elastic cord is utilized in association with headed members on lower portions of the legs to pull the lower portions of the legs together in the folded state of the easel.

19 Claims, 3 Drawing Sheets

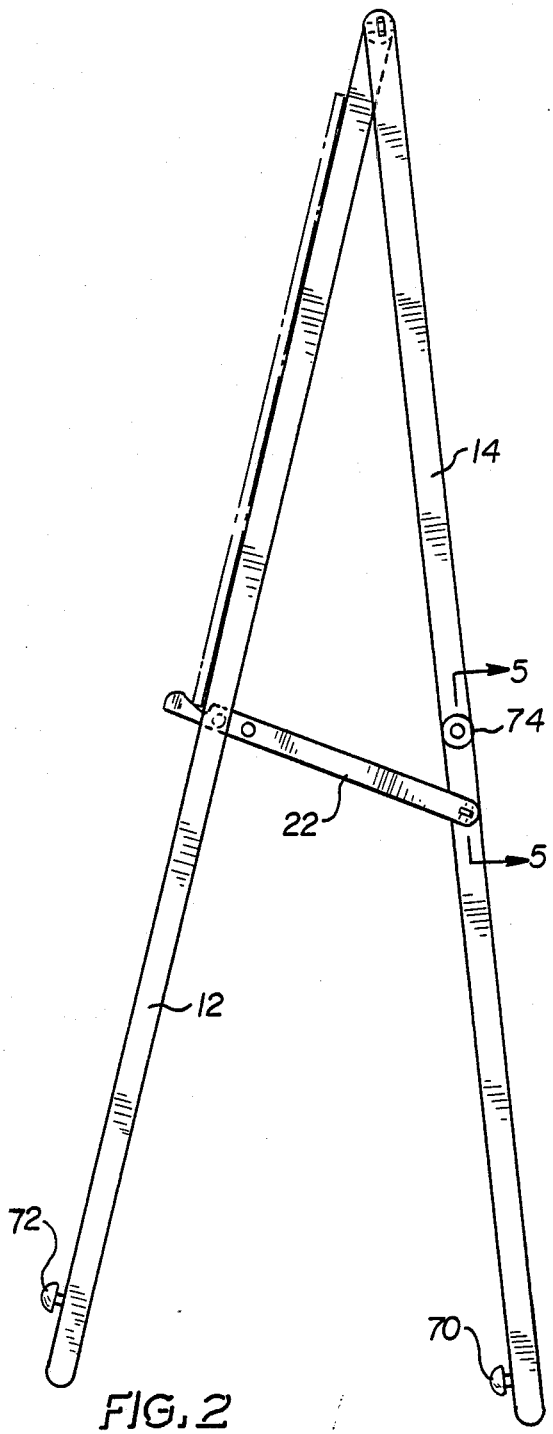
FIG. 2
FIG. 6
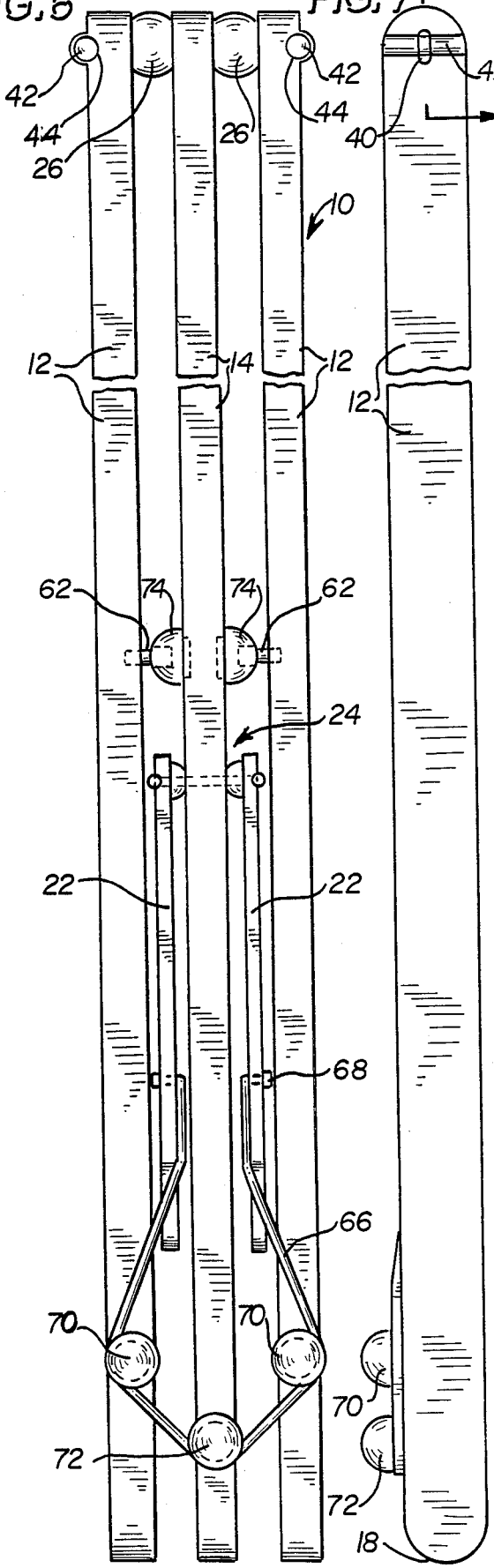
FIG. 7
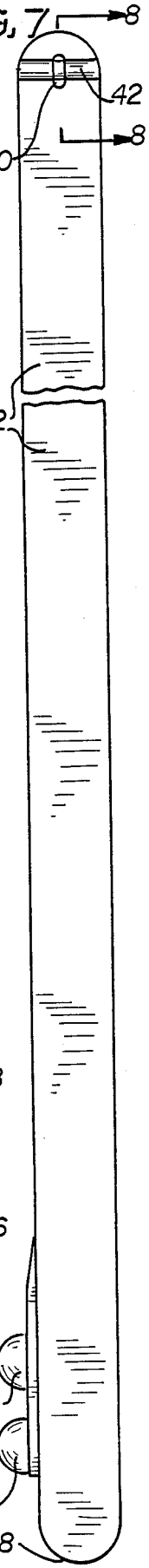

FOLDING EASEL

BACKGROUND OF THE INVENTION

This invention relates in general to new and useful improvements in folding easels, and more particularly to a folding easel having novel constructural details.

STATE OF THE PRIOR ART

Folding easels are typically constructed of three legs which are usually secured together at a top portion thereof through a joint which allows the legs to be brought together in a folded state or spread apart in triangular relationship to form a stable support for a board and the like. Chains or similar connectors are usually provided between the legs to determine the spacing therebetween. The joint for the legs ordinarily is relatively complex to allow two of the legs to pivot toward each other and the third leg to pivot away from the line between the other two. Examples of folding easels are disclosed in the following U.S. Pat. Nos.:

Werner, 294,941, issued Mar. 11, 1984;
Tepper, 2,064,232, issued Dec. 15, 1936;
Howell, 2,973,933, issued Mar. 7, 1961;
Rose, 3,201,080, issued Aug. 17, 1965;
Albee, Jr., 4,017,049, issued Apr. 12, 1977;
Carver et al, 4,171,116, issued Oct. 16, 1979.

SUMMARY OF THE INVENTION

According to the invention, there is provided an easel of simple construction employing the customary legs, but with support arms to space the legs apart and wherein the joints thereof employ simple elastic cords for forming pivots and forming a simple joint construction which accomplishes a complex function.

Basicially the easel includes two articulated joints, one between the upper ends of the three legs, and the other between the support arms and the central leg. Each articulated joint includes balls carried by outer legs of the joint components which are seated in sockets in the central leg of the joint components.

A further detail of the invention is the utilization of a loop of elastic cord which passes through the components to be joined together, including the balls, and wherein the loop is stretched and maintained in a tensioned state by pins received in the opposite ends thereof and seated in the outermost ones of the components.

Another feature of the easel is that pins which receive the support arms in the operative position of the easel, in the folded position of the easel fit in sockets carried by a central leg of the easel so as to maintain all three legs in a common plane.

A further feature of the easel is the utilization of a length of elastic cord extending between the support arms so as to retain the support arms in engagement with headed pins carried by the outer legs in the operative state of the easel with the elastic cord being engaged over headed elements carried by lower end portions of the legs in the folded state of the easel to urge the lower ends of the legs together.

BRIEF DESCRIPTION OF THE DRAWINGS

With the above and other objects in view that will hereinafter appear, the nature of the invention will be more clearly understood by reference to the following detailed description, the appended claims, and the several views illustrated in the accompanying drawings.

FIG. 2 is a side elevational view of the easel of FIG. 1.

FIG. 6 is a front elevational view of the easel in its folded state.

FIG. 7 is a side elevational view of the easel in its folded state.

DETAILED DESCRIPTION OF THE DRAWINGS

Figure 1:
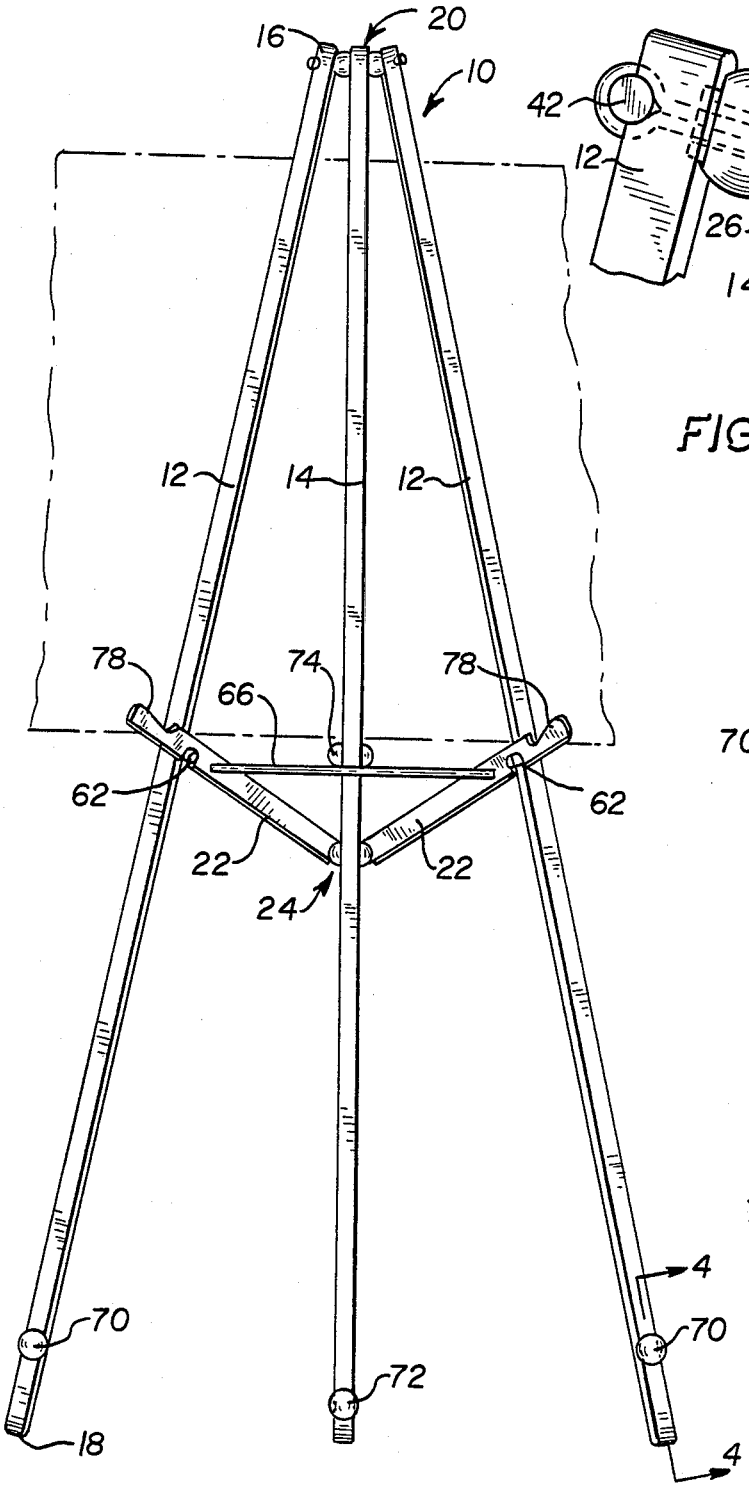
FIG. 1 is a front elevational view of the easel in its operative state.

Referring now to the drawings in detail, it will be seen that there is illustrated an easel which is formed in accordance with this invention. The easel is generally identified by the numeral 10 and is of a simple construction. Further, the easel 10 may be readily formed from components all formed of wood, with the exception of lengths of elastic cord so as to have a pleasing appearance both when in its operative state and when in its folded state ready for storage.

The easel 10 is formed of a plurality of components which include three legs, two outer legs 12 and a central leg 14. The legs 12, 14 have rounded upper ends 16 and similar rounded lower ends 18. The legs 12, 14 are joined together adjacent the upper ends 16 by an articulated joint forming a first connector means which is generally identified by the numeral 20 and which will be described in detail hereinafter.

The components of the easel 10 also include a pair of support arms 22 which are mounted on an intermediate portion of the central leg by way of an articulated joint forming a second connector means generally identified by the numeral 24. The support arms are releasably lockable with the outer legs 12 so as to maintain the easel in an upstanding operative state as will be described in detail hereinafter.

Figure 3:
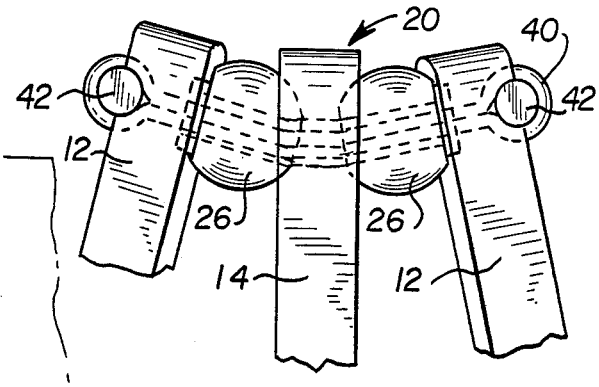
FIG. 3 is an enlarged elevational view of the upper ends of the legs of the easel showing the manner in which the legs are connected together utilizing an articulated joint.
Figure 4:
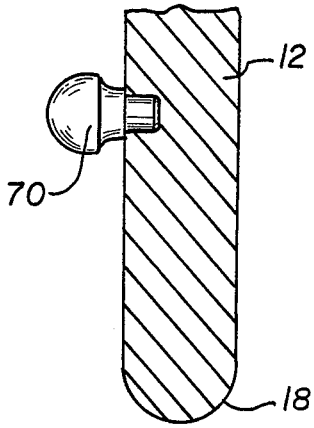
FIG. 4 is an enlarged fragmentary sectional view taken generally along the line 4—4 of FIG. 1 and shows the details of a headed member which is utilized to draw the lower ends of the easel together in the folded state of the easel.
Figure 8:
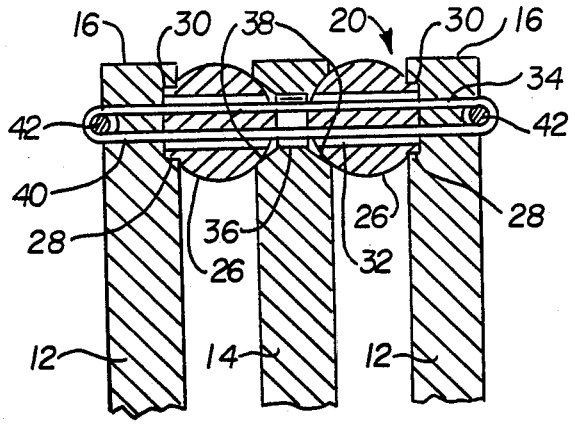
FIG. 8 is an enlarged fragmentary vertical sectional view taken generally along the line 8—8 of FIG. 7 and shows the details of the articulated joint between the three legs.
Figure 9:
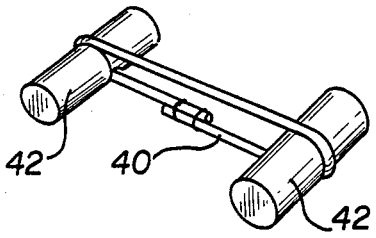
FIG. 9 is a perspective view showing the details of an elastic cord assembly utilizing the articulated joint of FIG. 8.

Reference is next made to FIGS. 3 and 8 where the details of the articulated joint 20 are illustrated. It will be seen that the outer legs 12 are each provided adjacent the upper ends 16 thereof with ball members 26. Each ball member 26 includes a mounting pin portion 28 which is circular in cross section and which is seated in a bore 30 formed in the respective outer leg 12. Each ball member 26 is provided with a bore 32 which extends through the ball member including the pin portion 28. Each of the outer legs 12 is provided with a transverse bore 34 therethrough which is aligned with and which is preferably of the same diameter as the bore 32 in the respective ball member 26.

The end portion of the central leg 14 is also provided with a through bore 36 which generally corresponds to the bores 32, 34. In opposite faces of the center leg 14, the bore 36 is enlarged so as to define sockets 38 for the ball members 26.

The articulated joint 20 is completed by a resilient connector such as an elastic cord 40 which is in the form of a flattened loop and which extends through the bores 32, 34 and 36. The opposite ends of the loop of elastic cord 40 have extending transversely therethrough retaining pins 42 which are seated in transverse grooves 44 in the outer or remote faces of the legs 12 as is best shown in the upper part of FIG. 6. The length of the elastic cord 40 is one wherein it is highly tensioned when in place. It thus tightly retains the ball members 26 in the sockets 38 while permitting the central leg 14 to pivot relative to the outer legs 12. Further, as is clearly shown in FIG. 3, when the central leg 14 is pivoted relative to the outer legs 12, not only does the elastic cord 40 function as a pivot member, but also permits a relative twisting of the outer legs 12 relative to the central leg 14 as is required to permit the support arms 22 to engage the outer legs in the operational state of the folded easel 10 as will be described in more detail hereinafter.

Figure 5:
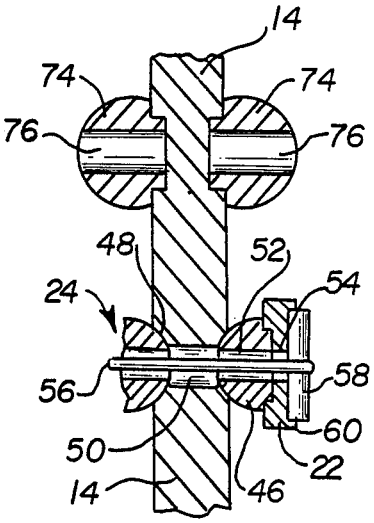
FIG. 5 is an enlarged fragmentary vertical sectional view taken generally along the line 5—5 of FIG. 2 and shows specifically the details of the articulated joint between the support arms and the center leg as well as details of sockets for receiving headed pins carried by the other legs.

The articulated joint 24 is of a construction very similar to that of the articulated joint 20 and is best illustrated in FIG. 5. Each of the support arms 22 is provided on an interface thereof with a projecting ball member 46. The ball members, in turn, are seated in sockets 48 formed in opposite faces of the central leg 14. The sockets 48 are joined by a transverse bore 50 in the central leg 14 and there are aligned bores 52, 54 through each ball member 46 and an aligned portion of the respective support arm 22, respectively.

Another resilient connector such as a loop of elastic cord 56 extends through the bores in the support arms 22, the ball members 26 and the center leg 14 and has the opposite ends thereof engaged over pins 58. Each pin 58 is seated in a groove or seat 60 formed in the outer face of the respective support arm 22. As in the case of the loop of elastic cord 40, the length of the loop of elastic cord 56 is one wherein the elastic cord is highly tensioned so as to tightly retain the ball members 46 in the sockets 48.

Figure 11:
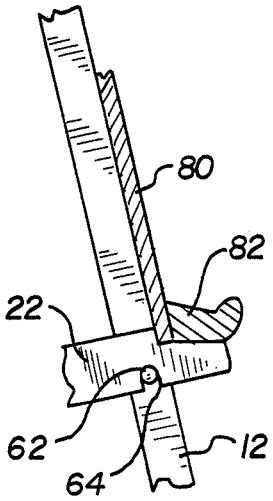
FIG. 11 is an enlarged fragmentary vertical sectional view taken generally along the line of 11—11 of FIG. 10 and shows the mounting of the mounting board including the details of a tray for markers.

Referring now to FIG. 11, it will be seen that each of the outer legs 12 is provided with a headed pin 62 with a small diameter portion of the pin 62 next to the inner surface of the outer leg 12 being received in a notch 64 formed in the underside of the respective support arm 22, thereby forming a thread connector means. The cooperation between the support arms 22 and the pins 62 serves to effect both a separation of the outer legs 12 and a twisting thereof as is clearly shown in FIGS. 1 and 3.

In order that the support arm 22 may be retained in position, a tensile connector such as an elastic cord 66 extends between the two support arms 22. The ends of the elastic cord 66 may be secured relative to the support arms 22 in any manner. The simplest way is to pass the ends of the elastic cord 66 through the support arms 22 and then knot the ends of the elastic cord with such knots 68 being best shown in FIG. 6.

The elastic cord 66 has a dual function. When the easel 10 is in its folded state, as shown in FIGS. 6 and 7, the elastic cord 66 serves to pull the lower ends of the outer legs 12 together. This is accomplished by providing the lower portions of the outer legs 12 with headed members 70. A similar headed member 72 is carried by the central leg 14 with the headed member 72 being closer to the lower ends of the legs than the headed members 70. Thus the headed members 70, 72 are arranged in a triangular fashion, as shown in FIG. 6. With this arrangement, not only are the outer legs 12 pulled towards one another, but also each leg is independently pulled towards the center leg 14.

The easel 10 has one further feature. As is best shown in FIGS. 5 and 6, the center leg 14 is provided above the bore 50 and the seats 48 with a pair of oppositely facing members 74. Each of the members 74 is actually in the form of a ball member, but could be of another configuration. Each ball member 74 is provided with a bore 76 therethrough. Each bore 76 is of a diameter to receive a head of a respective one of the headed pins 62, as is clearly shown in FIG. 6. This relationship locks the outer legs 12 in the same plane as the central leg 14 as is obvious from FIG. 7.

Figure 10:
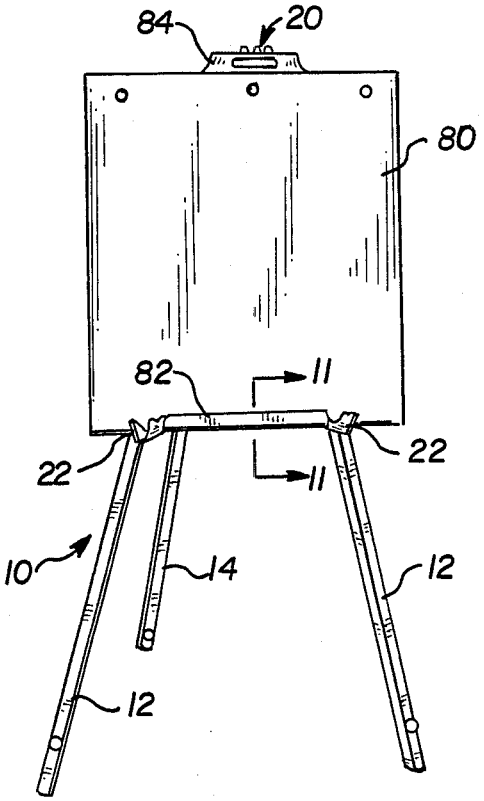
FIG. 10 is a front perspective view on a reduced scale showing the erected easel having a mounting board for a sketch pad mounted thereon.

With reference to FIGS. 10 and 11, it will be seen that while the easel is constructed to be utilized in the conventional manner, and the outer ends of the support arms 22 have recesses 78 formed in the upper surfaces thereof, the easel is particularly adapted for the mounting of a mounting board 80 for a sketch pad or blackboard which may be provided with a tray 82 for markers. The tray 82 will be in the central portion only of the mounting board 80 and will be positioned between the ends of the support arms 22 as is best shown in FIG. 10. A handle 84 can be provided at a top portion of the mounting board 80.

It is to be understood that with the exception of the elastic cords 40, 56 and 66, all components of the easel 10 may be formed of wood so as to have a pleasing appearance.

Further, it will be seen that the easel 10 may be readily folded for storage purposes and a plurality of like easels may be positioned side by side with respect to one another. In addition, when it is so desired, the components of the easel may be readily separated and reassembled without requiring any tools whatsoever except for something to stretch the elastic cords 40 and 56.

Although only a preferred embodiment of the folding easel has been specifically illustrated and described herein, it is to be understood that minor variations may be made in the easel construction without departing from the spirit of the invention and defined by the appended claims.

I claim:

1. A folding easel comprising a plurality of leg components, each having an upper end and a lower end, first connector means connecting together said upper ends of said leg components for relative swinging movement between a folded flat state in which the legs are substantially parallel and an operative state in which the lower ends of the leg components are spread apart in a diverging triangular relationship, support arm components for maintaining said leg components in said operative state, second connector means connecting said support arm components to one of said leg components for swinging movement, and third connector means on said support arm components and said other leg components for releasably securing said support arm components to said other leg components, at least one of said first and second connector means including resilient ball and socket connections between connected together components to twist between a parallel relation and a diverging angular relation and thereby accommodate the movement of said leg components from the folded state to the operative state.

2. A folding easel according to claim 1 wherein said at least one of said first and second connector means includes a central one of said leg components and two outer ones of said leg components and support arm components, and said ball-and-socket connections include a ball carried by each of said two outer leg components and two support arm components and sockets for said balls at opposite faces of said central leg component.

3. A folding easel according to claim 2 wherein said at least one of said first and second connector means includes a resilient connector urging said two outer leg components and two support arm components together to resiliently retain said balls in said socket.

4. A folding easel according to claim 2 wherein said at least one of said first and second connector means includes a resilient connector urging said two outer leg components together to resiliently retain said balls in said socket, said resilient connector being in the form of an elastic cord extending through said two outer leg components, said support arm components, said balls and said central leg component and forming a pivot member.

5. A folding easel comprising a plurality of leg components each having an upper end and a lower end, first connector means connecting together said upper ends of said leg components for relative swinging movement between a folded state in which the leg components are substantially parallel and an operative state in which the lower ends of the leg components are spread apart in a diverging triangular relationship, rigid support arm components for maintaining said leg components apart in said operative state, second connector means connecting said rigid support arm components for swinging movement from a folded state in which the arm components and leg components are in parallel relationship with each other to a diverging relationship in said operative state, and third connector means on said support arm components and said other leg components for releasably securing said support arm components to said other leg components, at least one of said first and second connector means including three of said leg components and arm components connected together by a universal resilient connector resiliently urging two outer ones of said leg components and support arm components towards a central one of said leg components to thereby accommodate the movement of the leg components and arm components from the folded state to the operative state.

6. A folding easel according to claim 5 wherein said resilient connector is in the form of an elastic cord extending through said three leg components and support arm components and forming a pivot member.

7. A folding easel comprising a plurality of leg components each having an upper end and a lower end, first connector means connecting together said upper ends of said leg components for relative swinging movement between a folded state and an operative state, support arm components for maintaining said leg components in said operative state, second connector means connecting said support arm components to one of said leg components for switching movement, and third connector means on said support arm components and said other leg components for releasably securing said support arm components to said other leg components, said third connector means including said support arm components having downwardly opening notches, said other leg components having generally oppositely facing headed pins to be received in said notches, and a resilient tensile connector extending between said support arm components to resiliently establish said easel in said operative position.

8. A folding easel according to claim 7 wherein said support arm components in said easel operative state extend beyond said other leg components and have upwardly facing recesses for positioning a panel-like member against said outer leg components.

9. A folding easel according to claim 7 wherein said one leg component has on remote faces thereof sockets for receiving said headed pin in the folded state of said easel to interlock together said leg components in a single plane.

10. A folding easel according to claim 9 wherein at least said other leg components have adjacent said leg components lower ends headed retainers for engagement by said tensile connector in the folded state of the easel to draw leg component lower ends together.

11. A folding easel according to claim 9 wherein leg components have adjacent said leg components lower ends headed retainers for engagement by said tensile connector in the folded state of the easel to draw leg component lower ends together, said headed retainers being arranged in a triangular pattern to apply a folded state retaining pressure on each of said leg components.

12. A folding easel according to claim 7 wherein at least said other leg components have adjacent said leg components lower ends headed retainers for engagement by said tensile connector in the folded state of the easel to draw leg component lower ends together.

13. A folding easel according to claim 7 wherein said resilient tensile connector is in the form of an elastic cord.

14. A folding easel comprising: a plurality of leg components, each having an upper end and a lower end, first connector means connecting together said upper ends of said leg components for relative swinging movement between a folded flat state in which the leg components are substantially parallel and an operative state in which the lower ends of said legs are spaced apart from each other in a substantially diverging triangular arrangement; means for maintaining said leg components in said operative state; and said first connector means including: a ball positioned between each of said leg components; and a resilient connector in the form of an elastic cord extending through said leg components and said balls to form a pivot member to permit the leg components to move in a universal manner from the folded flat state to the operative state.

15. A folding easel according to claim 14 wherein said elastic cord is doubled to form a loop having remote ends and each of said remote ends carries a retainer seated against a respective one of said outer leg components.

16. A folding easel comprising a plurality of leg components each having an upper end and a lower end, first connector means connecting together said upper ends of said leg components for relative swinging movement between a folded state in which the leg components are substantially parallel and an operative state in which the lower ends of the leg components are spread apart in a diverging triangular relationship, support arm components for maintaining said leg components in said operative state, second connector means connecting said support arm components to one of said leg components for swinging movement, and third connector means on said support arm components and said other leg components for releasably securing said support arm components to said other leg components, wherein at least one of said first and second connector means includes a central one of said leg components and two outer ones of said leg components and support arm components connected together by resilient ball and socket connections including a ball carried by each of said two outer leg components and two support arm components and sockets for said balls at opposite faces of said central leg component, and wherein said at least one of said first and second connector means further includes an elastic cord doubled to form a loop having remote ends and each of said remote ends carries a retainer seated against a respective one of said outer leg components and support arm components to urge said two outer leg components and support arm components together to resiliently retain said balls in said socket forming a pivot member.

17. A folding easel comprising a plurality of leg components each having an upper end and a lower end, first connector means connecting together said upper ends of said leg components for relative swinging movement between a folded state in which the legs are substantially parallel and an operative state in which the lower ends of the leg components are spread apart in a diverging triangular relationship, support arm components for maintaining said leg components in said operative state, second connector means connecting said support arm components to one of said leg components for swinging movement, and third connector means on said support arm components and said other leg components for releasably securing said support arm components to said other leg components, wherein each of said first and second connector means includes resilient ball and socket connections between connected together components to twist between a parallel relation and a diverging angular relation.

18. A folding easel comprising a plurality of leg components each having an upper end and a lower end, first connector means connecting together said upper ends of said leg components for relative swinging movement between a folded state in which the leg components are substantially parallel and an operative state in which the lower ends of the leg components are spread apart in a diverging triangular relationship, rigid support arm components for maintaining said leg components apart in said operative state, second connector means connecting said rigid support arm components to one of said leg components for swinging movement, and third connector means on said support arm components and said other leg components for releasably securing said support arm components to said other leg components, at least one of said first and second connector means including three of said leg components and arm components connected together by an elastic cord extending through said three leg components and support arm components and doubled to form a loop having remote ends wherein each of said remote ends carries a retainer seated against a respective one of said outer leg components and said support components, said elastic cord resiliently urging two outer ones of said leg components and support arm components towards a central one of said leg components.

19. A folding easel comprising a plurality of leg components each having an upper end and a lower end, first connector means connecting together said upper ends of said leg components for relative swinging movement between a folded state in which the leg components are substantially parallel and an operative state in which the lower ends of the leg components are spread apart in a diverging triangular relationship, rigid support arm components for maintaining said leg components apart in said operative state, second connector means connecting said rigid support arm components to one of said leg components for swinging movement, and third connector means on said support arm components and said other leg components for releasably securing said support arm components to said other leg components, each of said first and second connector means including three of said leg components and support arm components connected together by a universal resilient connector resiliently urging two outer ones of said leg components and support arm components towards a central one of said leg components.

* * * * *